US006314787B1

(12) United States Patent
Grønbæk

(10) Patent No.: US 6,314,787 B1
(45) Date of Patent: Nov. 13, 2001

(54) FORMING TOOL

(75) Inventor: Jens Grønbæk, Aabenraa (DK)

(73) Assignee: Danfoss A/S, Nordborg (DK)

( * ) Notice: Subject to any disclaimer, the term of this patent is extended or adjusted under 35 U.S.C. 154(b) by 0 days.

(21) Appl. No.: 09/601,090

(22) PCT Filed: Feb. 3, 1999

(86) PCT No.: PCT/DK99/00056

§ 371 Date: Jul. 27, 2000

§ 102(e) Date: Jul. 27, 2000

(87) PCT Pub. No.: WO99/39848

PCT Pub. Date: Aug. 12, 1999

(30) Foreign Application Priority Data

Feb. 6, 1998 (DE) ..... 198 04 700

(51) Int. Cl.[7] ..... B21C 25/02; B21C 3/06
(52) U.S. Cl. ..... 72/468
(58) Field of Search ..... 72/467, 274, 253.1, 72/468

(56) References Cited

U.S. PATENT DOCUMENTS 1,986,777 * 1/1935 Patterson ..... 72/467
2,539,716 * 1/1951 Bairstow ..... 72/467
2,559,679 * 7/1951 See ..... 72/468
3,440,862 * 4/1969 Phillips ..... 72/467
3,628,370 * 12/1971 Phillips ..... 72/467
3,740,990 * 6/1973 Prajsnar ..... 72/467
3,810,382 * 5/1974 Strandell ..... 72/467

FOREIGN PATENT DOCUMENTS

409994 * 7/1946 (IT) ..... 72/467
1304954 * 4/1987 (SU) ..... 72/467
1736655 * 5/1992 (SU) ..... 72/467

* cited by examiner

*Primary Examiner*—Daniel C. Crane
(74) *Attorney, Agent, or Firm*—Lee, Mann, Smith, McWilliams, Sweeney & Olhson

(57) ABSTRACT

A forming tool for extrusion has a die (5), which has a forming cavity (6) having at least one critical reference value. The die (5) is surrounded by a biasing ring (8), which bears against it with radial pre-stress. The die (5) and the biasing ring (8) have tampered contact surfaces (11) and are displaceable relative to one another. The biasing ring (8) is surrounded by a reinforcement (9), which bears against it with radial pre-stress. The biasing ring (8) and the reinforcement (9) are mounted in a fixed position on a carrier (housing 1). The die (5) is displaceable relative to the carrier and capable of being locked, by locking means (15, 19) on the carrier, in positions that can be selected. By that means it is possible subsequently to carry out a fine adjustment of the critical reference value over a wide correction range.

13 Claims, 1 Drawing Sheet

FORMING TOOL

Figure 1:
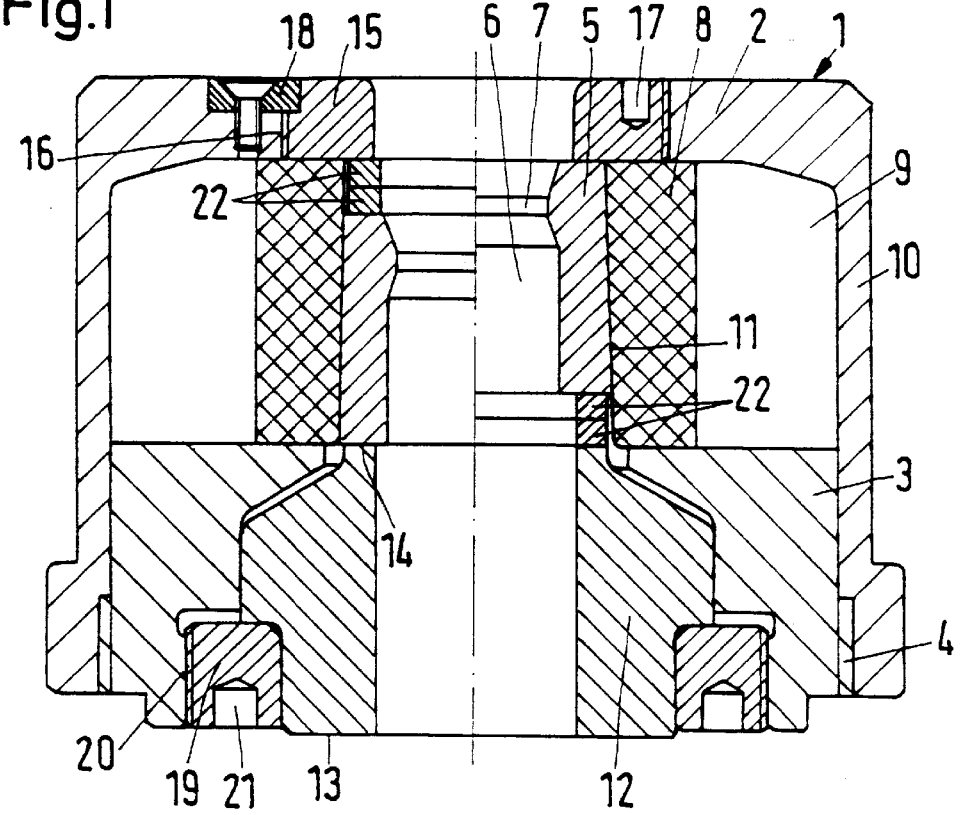

This application is a 371 of PCT/DK99/00056, filed Feb. 3, 1999, now WO 99/39848, published Aug. 12, 1999.

The invention relates to a forming tool having a die made from steel, sintered hard metal or ceramics, which die has a forming cavity having at least one critical reference value, a biasing ring, which surrounds the die and bears against it with radial pre-stress, and a carrier supporting the die and the biasing ring, the die and the biasing ring having tapered contact surfaces and being displaceable relative to one another.

The die cavity is used for the formation of workpieces by extrusion. Consequently, the workpieces, for example cylinders, cones, polygons or toothed arrangements, must have a high degree of accuracy, which requires forming tools having a very high degree of precision. The high pressure occurring during the forming process results in major resilient deformations of the die with the consequence that the final workpiece dimensions depart noticeably from the manufactured dimensions of the forming tools. Because of the complex distribution of pressure in cold flow tools, the resilient return after discontinuation of the process pressure and subsequent ejection of the workpiece from the die can be calculated only with difficulty, it frequently being the case that tools have to be scrapped as unusable either because they lack the dimensions necessary for highly accurate tool components from the outset or because they lack those dimensions as a result of wear after a certain period of operation.

DE 92 03 080 U discloses a forming tool of the kind described at the beginning. In that instance, the die is clamped in between two plates, which are connected to one another by means of posts. The biasing ring can be displaced relative to the die with the aid of a hydraulic ram. The tapered contact surfaces in that arrangement make it possible for the internal dimensions of the die to be varied steplessly without its being necessary for the die to be disassembled or reconditioned. It is therefore possible to correct inaccuracies, whether they have arisen during manufacture or as a result of wear in operation. In that arrangement, however, it is disadvantageous that the potential for correction is small.

It is known from DE 38 34 996 C2 or DE 43 11 249 C2 to surround the biasing ring by a reinforcement, which bears against it with pre-stress and consists of a wound band or of sintered hard metal. The reinforcement allows substantially higher pressures to be applied during extrusion. The die and the biasing ring have tapered contact surfaces, by means of which they can be brought into a prespecified fixed association with one another.

The problem underlying the invention is to provide a forming tool of the kind mentioned at the beginning that has a greater potential for correction.

The problem is solved according to the invention by an arrangement in which the biasing ring is surrounded by a reinforcement, which bears against it with pre-stress, and the biasing ring and the reinforcement are mounted in a fixed position on the carrier, and the die is displaceable relative to the carrier and capable of being locked, by locking means on the carrier, in positions that can be selected.

The reinforcement makes it possible, when the die is being adjusted, for substantially larger corrections to be made than previously, without the die or biasing ring or reinforcement breaking. Manufacture of the forming tool becomes cheaper because the critical reference values can subsequently be brought within the required tolerance ranges with great precision by displacement of the die relative to the biasing ring. Even when tools have become worn, it is possible to re-establish the critical reference value, so that the forming tools have a long service life. It should, however, be borne in mind that the reinforcement prevents the biasing ring from being adjustable and therefore the adjusting measures should be performed on the die.

It is advantageous for the carrier to be a housing surrounding the die, the biasing ring and the reinforcement. In that housing it is possible to mount securely, in a fixed position, the biasing ring and the reinforcement. In some cases, the outer wall of the housing can be used as additional reinforcement.

The housing suitably consists of two pieces connected to one another. In that way the die, the biasing ring and the reinforcement are especially easy to install. It is, however, also possible to manufacture a one-piece housing by injection-moulding about a core.

A housing comprising a cup-shaped piece and a base screwed thereto has proved especially suitable.

In a preferred embodiment, provision is made for the reinforcement to be formed by a wound band. Whereas, when a conventional outer ring is used as reinforcement, the maximum permissible radial pre-stress is approximately from 125 to 135% of the minimum pre-stress required for operation, the loading in the case of a band reinforcement may be 200% of the minimum pre-stress. When the band reinforcement is used, therefore, the range of adjustment is three times greater than in the case of a conventional reinforcement.

Furthermore, it is advantageous for there to be guided in the housing a ram having an exposed end face. With the aid of that ram, which can be actuated from the outside, for example by a hydraulic press, it is possible for the die to be displaced in the biasing ring.

Provision is advantageously made for the locking means to have two stops formed by threaded rings, which can be screwed into the housing, each of which stops is associated with an end face of the die. Such threaded rings allow the die to be locked securely in position after it has been steplessly adjusted.

In that arrangement, it is advisable for one of the threaded rings to act on the end face of the die by way of the interposed ram. By that means it is possible to arrange both threaded rings at the end faces of the housing so as to be freely accessible.

Spacer rings are preferably provided for bearing against the end faces of the die. By that means, the die can be displaced through a greater distance even when the locking means have only a limited range of adjustment.

It is especially advantageous for the inner face of the biasing ring to have undergone pre-treatment to reduce the surface roughness. There is then no risk that the die will be displaced jerkingly when it is being adjusted.

In a further embodiment, provision is made for the die to consist of at least two pieces positioned axially one behind the other. That is advisable when more than one critical reference value has to be met.

In that context, it is advisable for the second die piece in the direction of the narrowing of the taper to have a tapered surface having an angle of taper different from that of the first die piece. The difference in the slope of the tapered surfaces ensures that, when the die is displaced, both die pieces are subjected to a defined loading.

Figure 2:
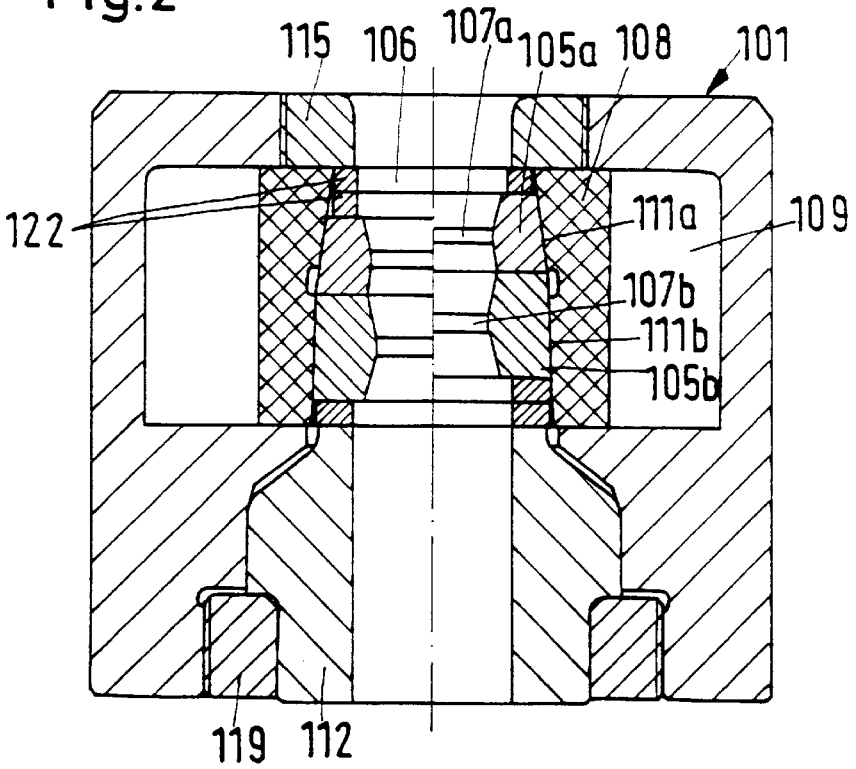

The invention is described below in greater detail with reference to preferred embodiments illustrated in the drawing, in which:

FIG. 1 shows a section through a forming tool according to the invention and FIG. 2 shows a section through a modified embodiment.

In FIG. 1, the forming tool has a carrier in the form of a housing 1, which consists of a cup-shaped upper piece 2 and a base 3 screwed to one another by means of a thread 4. Located inside the housing 1 is a die 5 made from steel, sintered hard metal or ceramics, which has a forming cavity 6 having a critical reference value at the location 7 and which in the left-hand half of the figure occupies a lower position and in the right-hand half of the figure occupies an upper position. The die 5 is surrounded by a biasing ring 8, which bears against it with radial pre-stress, which biasing ring 8 may likewise consist of steel, sintered hard metal or ceramics. The biasing ring 8 is surrounded by a reinforcement band 9 wound from a steel band, which bears against the biasing ring 8 with radial pre-stress. The peripheral wall 10 of the housing 1 forms an outer ring surrounding the wound band 9.

The contact surfaces 11 of the die 5 and the biasing ring 8 taper towards the top. A ram 12 is guided in the base 3, which ram 12 can be loaded on its lower end face 13 by a press, preferably a hydraulic press, and thus by means of its narrowed upper end face 14 can displace the die 5 upwards.

For locking the die 5 in the desired end position, there is used an upper locking means 15 in the form of a threaded ring, which has an external thread 16 and holes 17 for application of a tool and which can be secured against rotation by means of a block 18, which can be fixedly screwed in position. There is also provided a lower locking means 19 in the form of a threaded ring, which has an external thread 20 and holes 21 for application of a tool. That threaded ring acts on the ram 12 and, by that means, locks the die 5 in position.

When the die 5 is in the lower position (on the left in FIG. 1), two spacer rings 22 are located between the upper end face of the die and the upper locking means 15. After the upper locking means 15 has been slackened, the die 5 can be pushed upwards slightly and locked in position again. Once the upper spacer ring 22 has emerged completely from the biasing ring 8, it can be placed at the lower end face of the die 5. When the die 5 has been pushed further upwards and has come close to its end position, the second spacer ring 22 can also be transferred to the bottom (on the right in FIG. 1).

After the die has been manufactured, it is placed in the lowermost position in the housing 1. A test is carried out to establish whether the workpiece produced by extrusion has the correct dimensions. Because there is a linear relationship between the amount of axial displacement and the radial change in diameter, only a single adjustment step or only a few adjustment steps will be sufficient to obtain the desired dimensions.

By means of the locking means 19, the die can also be subjected to a constant axial stress, which is advantageous for many applications.

In the case of the embodiment according to FIG. 2, which is suitable for relatively complicated workpieces, reference numerals higher by 100 are used for corresponding components. One difference is that the housing 101 is constructed in one piece and is manufactured by injection-moulding about a core. Furthermore, the die consists of two die pieces 105*a* and 105*b*, which have two regions 107*a* and 107*b* having a critical reference value. The tapered contact surfaces 111*a* and 111*b* have different slopes. The die piece 105*a* located in the direction towards the narrowing of the taper has a greater angle of taper than the die piece 105*b*. The die is adjusted in a manner similar to that described in connection with FIG. 1.

The critical reference value-may refer, for example, to the diameter of a circular cross-section or a dimension of a non-circular cross-section, for example a toothed arrangement.

What is claimed is:

1. Forming tool having a die, which has a forming cavity having at least one critical reference value, a biasing ring surrounding the die and bearing against it with radial prestress, and a carrier supporting the die and the biasing ring, the die and the biasing ring having tapered contact surfaces and being displaced relative to one another, the biasing ring being surrounded by a reinforcement, which bears against the biasing ring with pre-stress, the biasing ring and the reinforcement being mounted in a fixed position on the carrier, and the die being displaceable relative to the carrier and capable of being locked, by locking means on the carrier, in positions that can be selected.

2. Forming tool according to claim 1, in which the carrier is a housing surrounding the die, the biasing ring and the reinforcement.

3. Forming tool according to claim 2, in which the housing consists of two pieces connected to one another.

4. Forming tool according to claim 3, in which the housing consists of a cup-shaped piece and a base screwed thereto.

5. Forming tool according to claim 1, in which the reinforcement is formed by a wound band.

6. Forming tool according to claim 2, including a ram guided in the housing, the ram having an end face which projects out of the housing.

7. Forming tool according to claim 2, in which the locking means have two stops formed by threaded rings, which can be screwed into the housing, each of which stops is associated with an end face of the die.

8. Forming tool according to claim 7, in which one of the threaded rings acts on the end face of the die by way of the interposed ram.

9. Forming tool according to claim 1, including spacer rings provided for bearing against an end face of the die.

10. Forming tool according to claim 1, in which the biasing ring has an inner face which has undergone pretreatment to reduce the surface roughness.

11. Forming tool according to claim 1, in which the die consists of at least two pieces positioned axially one behind the other.

12. Forming tool according to claim 11, in which the second die piece in the direction of the narrowing of the taper has a tapered surface having an angle of taper different from that of the first die piece.

13. Forming tool according to claim 1, in which the die is made from one of the group comprising steel, sintered hard metal and ceramics.

* * * * *